United States Patent [19]

Tada et al.

[11] Patent Number: 4,572,652

[45] Date of Patent: Feb. 25, 1986

[54] COPYING MACHINE WITH AUDIBLE INDICATOR MEANS

[75] Inventors: Mitsuro Tada, Nara; Takeshi Ikegami, Kurashiki; Hisao Komori, Nara, all of Japan

[73] Assignee: Sharp Kabushiki Kaisha, Osaka, Japan

[21] Appl. No.: 405,167

[22] Filed: Aug. 4, 1982

Related U.S. Application Data

[63] Continuation of Ser. No. 98,131, Nov. 28, 1979, abandoned.

[30] Foreign Application Priority Data

Nov. 29, 1978 [JP] Japan ..... 53-148041

[51] Int. Cl.[4] ..... G03G 15/00

[52] U.S. Cl. ..... 355/14 R; 355/14 C; 340/517; 340/692

[58] Field of Search ..... 355/14 R, 14 C, 3 R; 340/500, 568, 521, 517, 540, 52 F, 52 R, 27 R, 692

[56] References Cited

U.S. PATENT DOCUMENTS

| | | | |
|---|---|---|---|
| 3,689,151 | 9/1972 | Hofmann et al. | 355/14 R |
| 3,734,604 | 5/1973 | Szostak et al. | 355/14 R |
| 3,808,591 | 4/1974 | Panicello et al. | 340/27 R |
| 3,859,649 | 1/1975 | Slack | 355/14 R |
| 3,878,540 | 4/1975 | Kawai | 355/14 R |
| 4,135,143 | 1/1979 | Argentieri et al. | 340/27 R |
| 4,176,941 | 12/1979 | Breitenkam et al. | 355/14 R |

*Primary Examiner*—R. L. Moses

*Attorney, Agent, or Firm*—Birch, Stewart, Kolasch & Birch

[57] ABSTRACT

A new type of a copying machine which is easy to operate and particularly indicates the operator of how to use the copying machine from time to time. There is provided a copying machine having a plurality of detectors monitoring the operating condition of the copying machine and a memory for previously storing therein operational statements indicative of the operation and the condition of the copying machine. Respective ones of the statements are selected from the memory according to the outputs of the detectors for converting the selected ones of the statements into audible sounds or typically synthesized voices.

8 Claims, 12 Drawing Figures

| AD | | | AD | | |
|---|---|---|---|---|---|
| NA | "over" | E | NI | "ready" | E |
| NB | "original" | E | NJ | "jam" | E |
| NC | "density" | E | NK | "master" | E |
| ND | "cassette" | E | NL | "check" | E |
| NE | "howmany" | E | NM | "set" | E |
| NF | "replenish" | E | NN | "peep" | E |
| NG | "toner" | E | NO | "developer" | E |
| NH | "wait" | E | NP | "service" | E |

RM

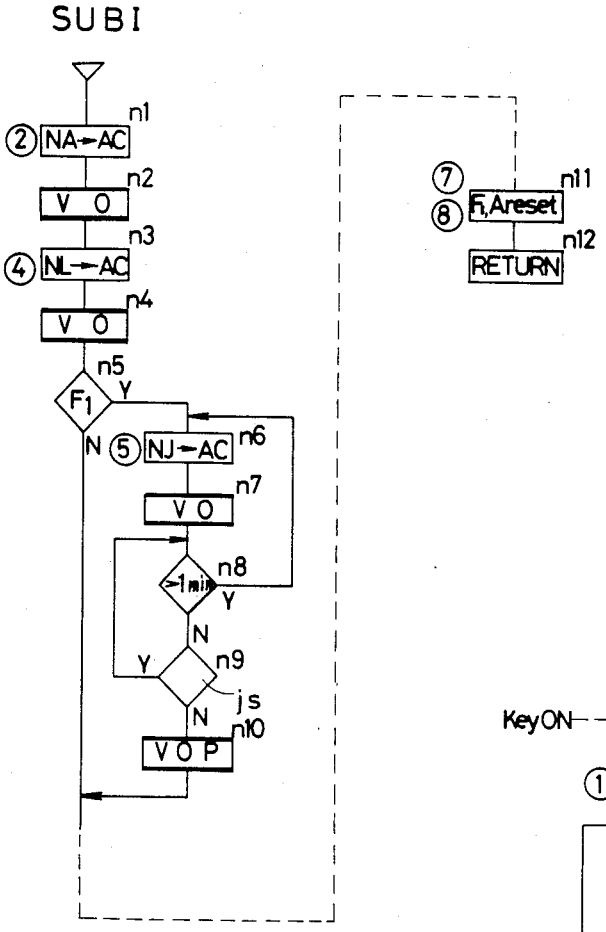
FIG. 5
FIG. 4
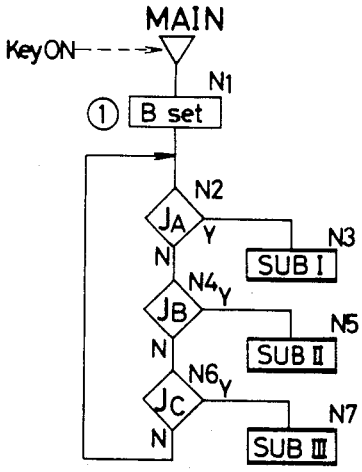

COPYING MACHINE WITH AUDIBLE INDICATOR MEANS

This application is a continuation of copending application Ser. No. 098,131, filed on Nov. 28, 1979, now abandoned.

BACKGROUND OF THE INVENTION

This invention relates to a new type of an electrostatic copying machine and more particularly to an operation indicator means for indicating to the operator by means of a particular recognition means what type of operations to do next.

In the past, the operator of a copying machine was informed as to what type of operation to do through the utilization of a visual display, such as a lamp.

For example, a lamp "WAIT" energized for a period of time from power throw up to start-up, a lamp "READY" energized for a period of time where the copying machine is available, and a lamp "JAM" energized when any copy sheet is jammed, etc. informed the operator of the operating state of the copying machine so that the operator might perform a desired operation pursuant to the operating states of those lamps.

One who was unfamiliar with the copying machine might not know how to solve the problem indicated by one of those lamps.

For copying machines it is generally necessary to mount an original on an original table, load a copy sheet cassette into a sheet feed station, set the amount of light exposure or the copy density, set the desired number of copies and so forth prior to the copying operation. If the lamp "READY" is on at the completion of those preparations, the operator can press a copy switch to initiate the copying operation. When the copying machine suffers from a jam trouble and so forth during the copying operation, the operator should remedy it. A periodic checkup is also needed for maintenance and preservation of copying machines.

The prior art copying machine used displays, for example, lamps, LEDs and ECDs, as a recognition means, which displays were difficult and complicated to increase their displaying capacity. More particularly, in the case where anyone, whether trained or not, is authorized to operate the copying machine, the operator himself may have difficulty in remedying erroneous conditions indicated by the warning lamps. The more complicated the machine the stronger such the tendency. One who will operate the copying machine for the first time, typically a coin-operated copying machine, probably does not understand how to remedy erroneous conditions of the machine by merely looking at the warning lamps.

SUMMARY OF THE INVENTION

With the foregoing in mind, it is an object of the present invention to provide a new type of a copying machine which is easy to operate and particularly indicates to the operator how to use the copying machine from time to time. The present invention overcomes the time-honored concept relying upon displays as the above mentioned indicator or recognition means and makes possible auditory indication or recognition.

According to the present invention, there is provided a copying machine comprising a plurality of detector means for monitoring the operating condition of the copying machine, a memory means for previously storing operational statements necessary for the operation or the condition of the copying machine, a control circuit means for selecting respective ones of the statements from the memory means according to the outputs of the detector means and an audible display means for converting the selected ones of the statements into audible sounds or typically synthesized voices.

BRIEF DESCRIPTION OF THE DRAWINGS

For a more complete understanding of the present invention and for further objects and advantages thereof, reference is now made to the following description taken in conjunction with the accompanying drawings, in which:

FIGS. 4 through 10 are flow charts for explanation of operation of the copying machine according to the present invention.

DETAILED DESCRIPTION OF THE INVENTION

Figures 1, 3:
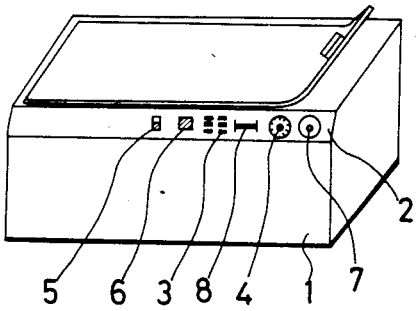
FIG. 1 is a perspective view of the outer appearance of a copying machine according to the present invention.
FIG. 3 details an operation storage shown in FIGS. 2(*a*) through 2(*c*)

Referring now to FIG. 1, there is illustrated a perspective view of a copying machine embodying the present invention which comprises a body 1 having a lid overlying an original platform on which an original is placed and an operational panel 2 carrying a loud speaker 3 for releasing operational commands in the form of voices, a number setting dial 4 for setting the number of copies, a power switch 5, a start switch 6 for waiting for a next operational demand subsequent to the placement of the original, a copy switch 7 for starting copying operation and a knob 8 for adjusting the copy density. Although not shown, a plurality of detectors with a well known structure such as a photo-coupler are provided inside and outside the copying machine for monitoring its operational condition. For example, the detectors include an original detector for deciding if the original is on the original platform, a cassette detector for deciding if the maching body 1 is loaded with a copy sheet cassette, switch detectors deciding if the start switch or the copy switch is actuated, a number detector for determining how many copies are needed, an operation detector for deciding if copying operation has started upon the actuation of the copy switch, a jam detector for sensing a jammed copy sheet and any other types of detectors, all of which are kept in place.

The copying machine will operate as follows: The operator first throws on the power switch 5 and the loud speaker 3 releases a monotone such as "peep" since no erroneous condition is found. Voices such as "set" and "original" follow in sequence. Pursuant to those operation instructions the operator mounts the original on the platform, covers the original with the lid and actuates the start switch 6(S). The copying machine immediately delivers operational instructions "set" and "density" from the loud speaker 3 in the form of voices. If the operator rotates properly the density adjusting knob 8 and actuates again the start switch 6, then audible instructions "set" and "how many" are successively delivered from the loud speaker 3. The operator follows these instructions and thus sets the number of copies through the number dial 4. Upon a further actuation of the start key 6 instructions "set" and "cassette" are successively delivered toward the operator.

After the achievements of all of the desired operations by the operator, the copying machine itself checks by use of the detectors whether the original, the cassette, the number switch, etc. are properly placed. If everything is OK, the ready lamp is then energized together with the delivery of a voice "ready" from the loud speaker, indicating that the machine is now available and ready to make copies upon the actuation of the copy switch. If not, the instructions "cassette", "check", "toner", "replenish", etc. are audibly delivered.

Copying operation will start upon actuation of the copy switch 7 under the condition where the original is mounted on the platform and the machine is all set. The machine operates while checking by means of the outputs of the respective detectors if any trouble happens with the machine. If so, an additional step is commenced with the delivery of audible information or indications "trouble" and "check" for setting the machine free of the trouble. The loud speaker 3 releases a monotone "peep" for a relatively long length of time (say, 1 minute) until the machine is clear of the trouble. For example, when the copy sheet is jammed, the speaker 3 releases a voice of "jam" at an interval of an appropriate length of time until the operator or a serviceman removes the jammed copy sheet. After the removal of the jammed copy sheet the machine is restored to its initial condition. An erroneous condition will be described in terms of only a jam in the following description with respect to one preferred embodiment of the present invention.

Moreover, the illustrated embodiment is provided with the capability of delivering audible instructions or statements as to periodic checkup and maintenance. In other words, if the count of a built-in counter of the machine reaches a specific number of total copies, for example, 400 copies, the speaker 3 provides audible instructions "master" in the form of a voice to indicate to the operator to exchange a master paper (i.e., a temporary photosensitive drum). If it becomes necessary to exchange a developing agent and typically at the completion of a total of 6,000 copies, then instructions concerning "developer" are delivered in the form of voices in reply to the output from the above-mentioned copy counter. In addition, if the time comes when the machine demands periodic checkup, "service" is audibly displayed, indicating that the operator should exchange the master paper the developing agent and so forth and telephone the serviceman.

As stated above, the copying machine according to the illustrated embodiment has three functions, the function of instructing the copying procedure step by step, the function of audibly warning the operator of any trouble with the machine and the function of informing him of the necessity for maintenance, all of which are at work after power throw.

Figure 2A:
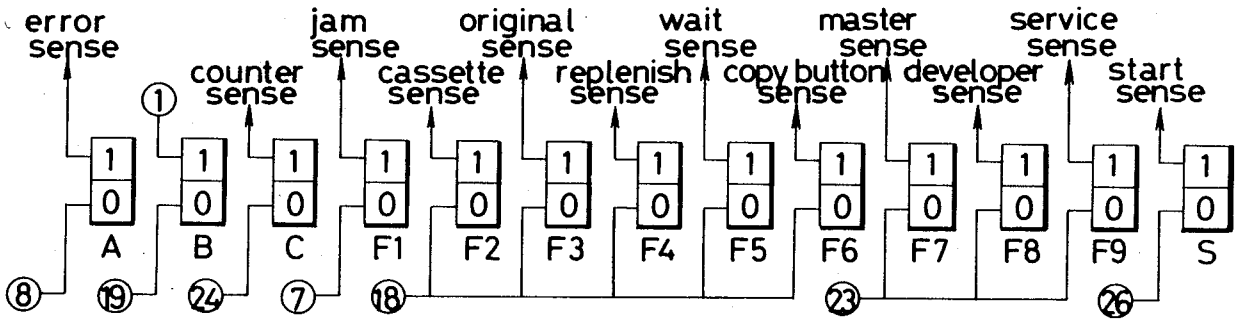
FIGS. 2(*a*) through 2(*c*) are block diagrams showing a control circuit configuration of the copying machine according to the present invention.
Figure 2B:
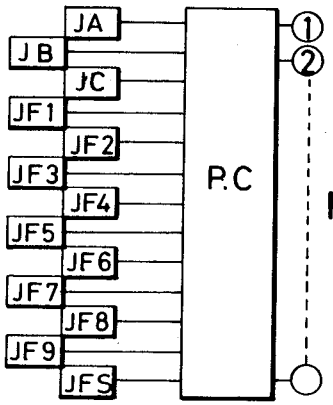
Figure 2C:
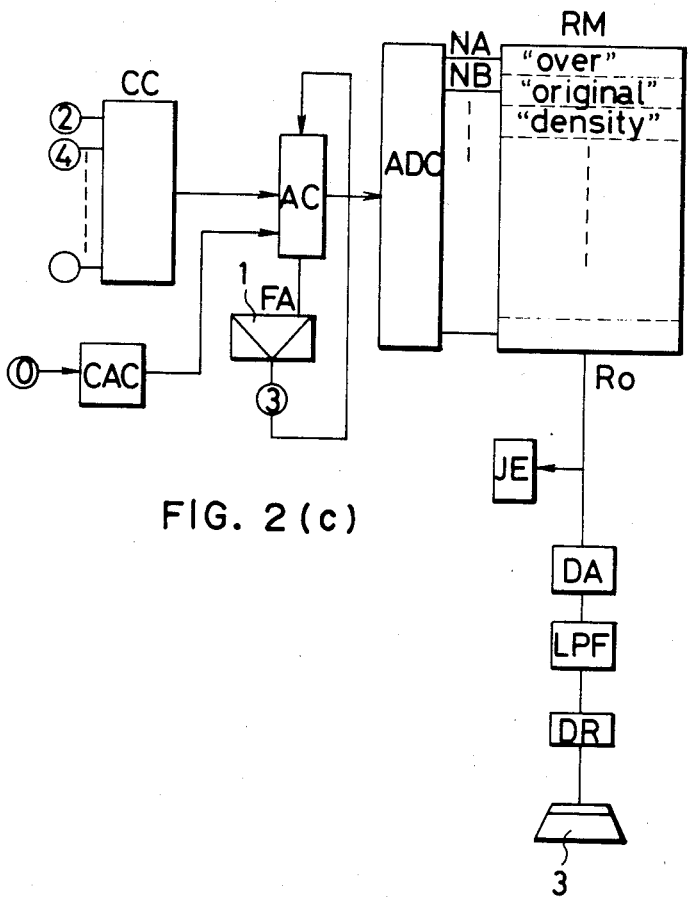

FIGS. 2(*a*) through 2(*c*) are schematic block diagrams of a control circuit arrangement for executing the above operation according to the present invention. FIG. 2(*a*) shows a chain of flip-flops A,B,C, $F_1$–$F_9$ and S receiving at their set terminals the outputs of the detectors secured within the machine. The flip-flop A receives a signal indicative of any machine trouble during copying operation, flip-flop B receives a signal developed when no trouble occurs after power throw, and the flip-flop C receives a signal when maintenance such as the exchange of the photosensitive master paper is necessary. The flip-flop $F_1$ responds to a signal indicative of a jam in the course of copying operation, the flip-flop $F_2$ to a signal indicating that the machine is loaded with the cassette, the flip-flop $F_3$ to a signal indicating that the original is mounted, the flip-flop $F_4$ to a signal indicating whether the developing agent such as toner is present in the developer station, the flip-flop $F_5$ to a signal indicating that the machine is available and ready to copy, the flip-flop $F_6$ to a signal indicating that the copy switch 7 is actuated under the ready condition of the machine, the flip-flop $F_7$ to a signal from the counter indicating that it is necessary to exchange the master member typically at completion of 400 copies, the flip-flop $F_8$ to a signal indicating the necessity for the exchange of the developing agent typically developed when the count of the copy counter runs up to 6,000, and the flip-flop $F_9$ to a signal indicating the necessity for calling the serviceman typically developed when the counter counts 100,000 copies. The flip-flop S is set upon the receipt of a signal from the start switch 6. Decision circuits JA, JB, JC, $JF_1$–$JF_9$ and JS as shown in FIG. 2(*b*) sense the set outputs of the respective flip-flops and provide their outputs for a sequence control circuit PC which in turn develop micro-instructions 1 , 2 , . . . according to the set signals from the flip flops. These micro-instructions open or close respective gate circuits. When it is desired to store the operating conditions of the flip-flops and the present sequence of the sequence control circuit PC, it is at least necessary to connect the both to a back-up power supply.

An ROM (read only memory) CC in FIG. 2(*c*) delivers selectively the initial address of an operation store RM upon the development of the micro-instructions. The selectively delivered initial address is applied to the address counter AC and decoded via the decoder ADC, thus selecting the head of a desired operation. The operation store RM, as indicated in FIG. 3, is a read only memory (ROM) which stores a number of data quantizing sound elements in order to develop operational words each word ending with an "end code". For example, the initial address "NA" contains binary data indicative of word elements "over" together with the end code and the next succeeding address "NB" contains likewise word elements "original". The decision circuit $J_E$ checks the respective word elements fetched from the operation store RM character by character and decides if there is the end code and, if not, increments the count of the address counter AC. In other words, the adder FA executes operation of AC+1 and loads the results into the address counter AC. For example, if the word element relating the operation "original" (its Japanese version is "genkoh") is derived from the operation store RM via the address store ADT, the sequence control circuit PC provides the micro-instruction 2 so that the initial address "NA" is loaded into the address counter AC and the leading word element "ke" is not in agreement with the end code as decided by the decision circuit $J_E$, the counter AC is incremented to fetch the next succeeding word element $R_O$ "sonant" (it comes to "ge" in Japanese). When the decision circuit $J_E$ senses the presence of the end code derived from the operation store RM, the address counter AC is inhibited from being incremented. In other words, the micro-instruction 3 disables the gate and inhibits the counter AC from being incremented.

It will be noted that the reset circuit CAC is at work to reset the count of the address counter AC at the time of power throw or during the warm-up period. The digital-to-analog converter DA convert the output $R_O$ of the operation store RM from a digital form to an analog form, the analog form of the binary data being indicative of the respective word elements. The low-pass filter LPF removes high frequency components out of the whole output of the digital-to-analog converter DA and allows only low frequency components suitable for the generation of sounds. Sound signals passing over the low-pass filster LPF are amplified through the next stage driver DR and released in the form of audible sounds via the loud speaker 3.

The above described circuit arrangement will operate as follows, of which flow charts are illustrated in FIGS. 4 through 10. FIG. 4 shows a main routine which is executed when power is thrown or during warm-up period. The sequence control circuit PC governs the events in the flow charts of FIGS. 4 through 10, which events are written into the sequence control circuit PC.

After the power switch 5 is flipped on, the sequence control circuit PC develops the micro-instruction 1 during the step $N_1$, thus setting the flip-flop B. This meets one of conditions for plunging into a subroutine "SUB II" as will be described later. Thereafter, the step $N_2$ decides if the flip-flop A is in the set state. The flip-flop A is set when the copying machine is in any erroneous state. To this end the subroutine "SUB I" is commenced during the step $N_2$ as shown in FIG. 5 for announcing to the operator of that erroneous state. Assume now that the flip-flop A is neither set nor be the copying machine out of order. After decision as to the flip-flop A the step $N_4$ takes effect to decide if the flip-flop B is in the set state. In this instance, since the flip-flop B is already set upon power throw, a subroutine "SUB II" (the step $N_5$) is reached for governing an audible display of the sequential steps.

Figure 6:
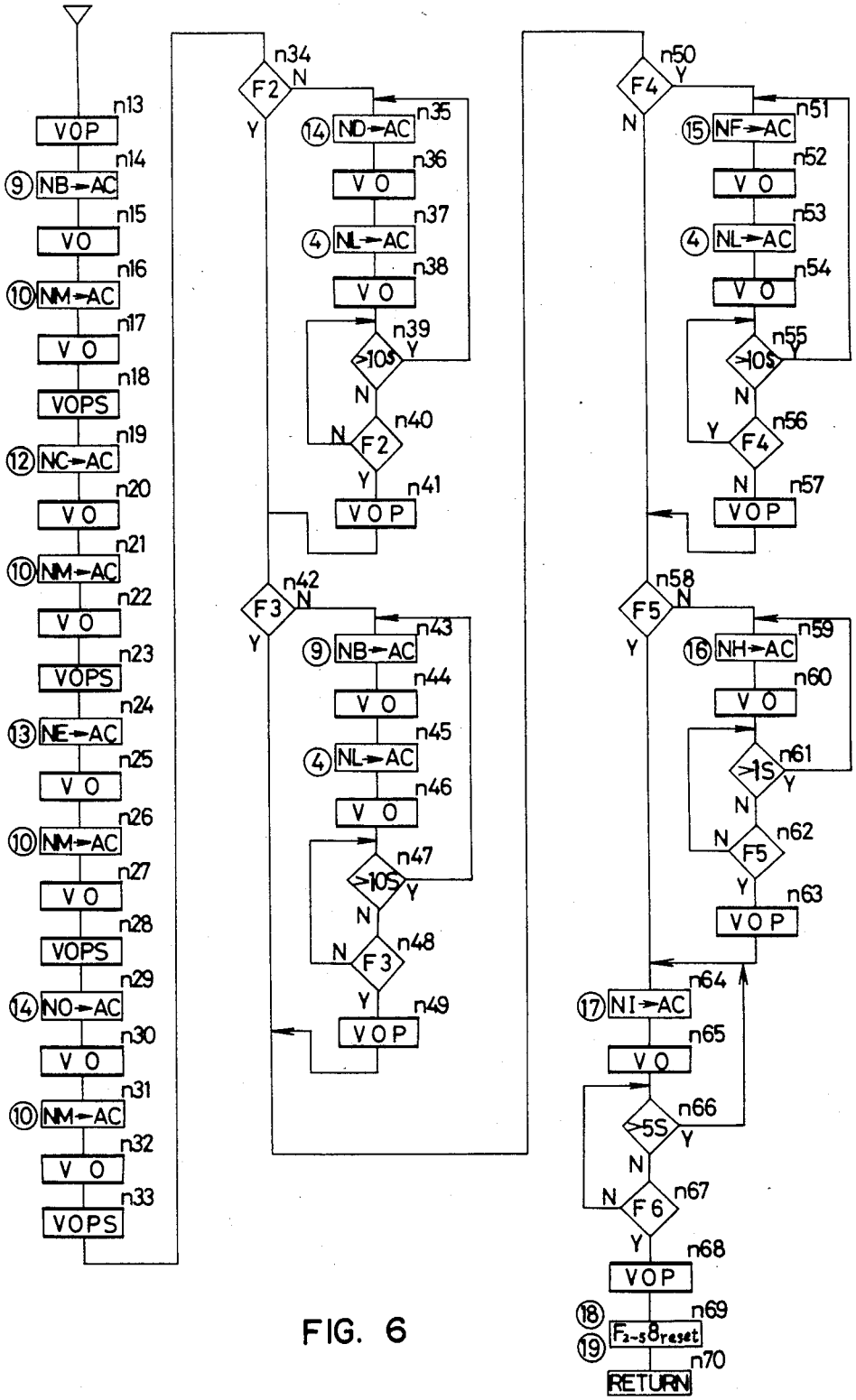
Figure 9:
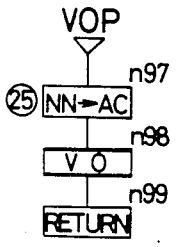

The subroutine "SUB II" is illustrated in FIG. 6, wherein the subroutine is merged into a subroutine "VOP" at the step $n_{13}$ of FIG. 6. The subroutine "VOP", as indicated in FIG. 9, enables the sequence control circuit PC to provide the micro-instruction 25 at the step $n_{97}$. This leads to that the initial address "NN" is unloaded from the address store CC into the address counter AC. The count of the address counter AC is decoded via the decoder ACD and the respective words at "NN" are derived in sequence from the operation store RM. A subroutine "VO" (see FIG. 10) is reached at the next step $n_{98}$ and the end code decision circuit $J_E$ decides at the step $n_{100}$ if $R_o$ from the operation store RM is the end code. Otherwise, the step $n_{101}$ is executed to generate the micro-instruction 3 and increment the count of the address counter AC. The next succeeding word $R_O$ is read out from the operation store RM for decision as to $R_O$. If the end code is found, then the word element "peep" and the micro-instruction 0 at the step $n_{102}$ are derived from the operation store RM, thus resetting the address counter AC. The sound quantizing data concerning the word elements "peep", quantizing data concerning the word elements "peep", on the other hand, are converted into audible sound signals via the digital-to-analog converter DA and then audibly delivered via the low-pass filter LPF and the driver DR from the loud speaker 3. The sound "peep" forces the operator to pay attention on what to do next.

Figure 10:
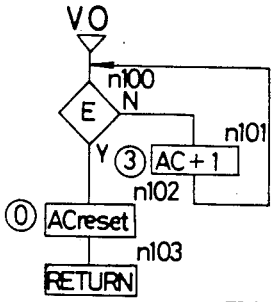

Thereafter, the step $n_{14}$ of FIG. 6 is returned where the initial address "NB" is transferred from the address store CC into the address counter AC in response to the micro-instruction 9 . A subroutine "VO" as shown in FIG. 10 comes into effect during the next step $n_{15}$. Accordingly, the respective word elements $R_O$ "original" are sequentially derived from the operation store RM and audibly delivered from the loud speaker 3. During the next step $n_{16}$ the initial address "NM" is loaded into the address counter AC, enabling the sound quantizing data $R_O$ "set" corresponding to "NM" to be derived at the step $n_{17}$. The synthesized voice "set" is delivered from the loud speaker so that the delivery of the synthesized voices "original" and "set" (note: the order of the voices in Japanese is opposite to that for English in many cases like this) advises the operator to mount the original on the original platform.

Under these circumstances the copying machine itself is waiting for the start switch 6 to be actuated. In other words, a subroutine "VOPS" (see FIG. 8) becomes operative during the step $n_{16}$, followed by the steps $n_{92} \rightarrow n_{93}$ for releasing the sound "peep" and deciding if the flip-flop S is in the set state. The flip-flop S is one that is set when the start switch 6 is actuated. When the switch 6 is actuated the step $n_{95}$ is executed where the micro-instruction 26 is developed to reset the flip-flop S, followed by the subroutine II during $n_{19}$. In this manner, the monotone sound "peep" follows the synthesized voices "original" and "set" and the operator is waiting for the next instruction by the copying machine after he has mounted the original and actuated the start switch 6.

Upon the actuation of the start switch 6 the step $n_{19}$ is effected to derive the respective word elements of the sound quantizing data concerning "density" from the instruction store RM. The synthesized voice "density" is delivered during the step $n_{20}$ and the synthesized voice "set" is delivered during the steps $n_{21}$ and $n_{22}$. In reply to the audio instructions "density" and "set" the operator rotates the density adjusting knob 8 for density adjustment. After that, the copying machine waits for the start switch 6 to be pressed and is ready for the next instruction.

The operator then actuates the start switch 6 for knowing what he should do next. Through a chain of the steps $n_{24} \rightarrow n_{25} \rightarrow n_{26} \rightarrow n_{27} \rightarrow n_{28}$ the synthesized voices indicative of "how many" and "set" are delivered, followed by the monotonous sound "peep" indicating the operator to operate the start switch 6 and then to set the number of necessary copies by the use of the number setting dial 4.

When the number of copies are selected and the start switch 6 is depressed, the synthesized voices "cassette" and "set" are reproduced via the steps $n_{29} \rightarrow n_{30} \rightarrow n_{31} \rightarrow n_{32} \rightarrow n_{33}$, ended with the monotonous sound "peep". So the operator loads the sheet feed station of the copying machine with the cassette containing a number of copy sheet of a desirable size and depresses again the start switch 6. When this occurs, the step $n_{34}$ is conducted to decide if the flip-flop $F_2$ is in the set state. The flip-flop $F_2$ stands in the set state when the machine is loaded with the cassette or otherwise the sheet feed station contains a number of the copy sheets. The flip-flop $F_2$ is in the set state as far as the operator loads the machine with the cassette properly subsequent to the delivery of the synthesized voices "cassette" and "set". The step $n_{42}$ is then conducted to decide if the flip-flop $F_3$ is in the set state. If the flip-flop $F_2$ is not in the set state or if the cassette is properly placed, the synthesizsed voices "cassette" and "check" are delivered via the step $n_{35} \rightarrow n_{36} \rightarrow n_{37} \rightarrow n_{38}$, indicating to the operator to keep the cassette in place within the copying machine. In this case, the above described voices "cassette" and "check" are delivered every 10 seconds to inform the operator of the need to place properly the cassette unless the cassette is in a wrong position. If the cassette is moved properly, the step $n_{40}$ is effected to see if the flip-flop $F_2$ is in the set state, followed by the step $n_{41}$ where the monotonous sound "peep" is allowed to be released from the loud speaker 3. The step $n_{42}$ follows.

After the completion of the loading the steps $n_{42}$, $n_{50}$ and $n_{58}$ are conducted just as the checkup of the cassette to see if the original is mounted, if the amount of tone is appropriate, if the machine is ready to make copies or otherwise. If all of the items are found proper, then the step $n_{64}$ is carried out to load the initial address "NL" into the address counter AC and initiate the delivery of the synthesized voice "ready" during the step $n_{65}$. The operator is informed that the machine is now ready to operate upon the actuation of the copy switch 7. Unless the copy switch 7 is actuated the voice "ready" is repeatedly delivered every 5 seconds. The step $n_{42}$ is conducted to check if the flip-flop $F_3$ is in the set state or if the original is mounted in place.

Otherwise, the instructional words "original" and "check" are delivered via the step $n_{43}$–$n_{46}$ just as the words "cassette" and "check". With the original in place, the flip-flop $F_4$ (the step $n_{50}$) is checked as to whether the amount of the toner is appropriate. If there is no need to replenish the machine with the toner, the step $n_{42}$ is carried out if the flip-flop $F_5$ is in the set state. When the temperature of a fixing station of the copying machine reaches within a range of permissible temperatures, the flip-flop $F_5$ is in the set state and the step $n_{64}$ is effected to release the synthesized voices "ready" from the speaker 3 until the copy switch 7 is actuated. On the contrary, if these temperatures are not reached, the steps $n_{59} \rightarrow n_{60}$ are conducted to enable the loud speaker 3 to deliver the voice "wait". Thereafter, if the temperature is within the permissible range, the the flip-flop $F_5$ is in the set state and the voice "ready" is delivered via the steps $n_{62} \rightarrow n_{63} \rightarrow n_{64} \rightarrow n_{65}$.

Under the "ready" condition the copy switch 7 is actuated to start copying operation. Upon the actuation of the copy switch 7 the flip-flop $F_6$ is set to make the steps $n_{67}$ and $n_{68}$ operative. The monotonous sound "peep" is released from the speaker 3 for confirmation. During the next step $n_{69}$ the micro-instructions 18 and 19 are developed to reset the flip-flops B, $F_2$–$F_6$. The main routine $N_6$ of FIG. 6 is returned.

The flip-flop C is one that is to be set during the step $N_6$ of the main routine of FIG. 6 when it is necessary to exchange the master sheet (photosensitive) or otherwise. In this case the flip flop C is in the reset state. As long as a cycle of the steps $N_2 \rightarrow N_4 \rightarrow N_6$ is repeated and the copying machine goes on normally operating, the machine comes to a stop immediately upon the completion of a necessary number of copies.

If the machine is in trouble during copying, that error signal places the flip-flop A into the set state. When this occurs, the steps $N_2$ and $N_3$ are consecutively effected to initiate the subroutine "SUB I" concerning the warning of any error. As depicted in a flow chart of FIG. 5, the address register AC is loaded with the initial address "NA" in order to derive the sound quantizing data "over" from the instruction store RM during the step $n_1$. The step $n_2$ is effected to deliver the voice "over", followed by the step $n_3$ where the address register AC is loaded with the initial address "NL" to derive the word elements "check" from the instruction store RM. The voices "over" and "check" are delivered to warn the operator of the error with the coying machine. Then, the copying machine itself informs the operator of the occurrence of the error. The error will be described in terms of a jam in the following functional description.

The step $n_5$ is effected to sense whether the flip-flop $F_1$ is in the set or reset state. The flip-flop $F_1$ is in the set state in the presence of a jam. Therefore, the step $n_6$ is effected to develop the micro-instruction 5 and load the address register AC with the initial address "NJ".

During the next step $n_7$ the sound quantizing data indicative of "jam" from the instruction store RM are converted into audible frequency signals which in turn are released from the speaker 3. This instructs the operator only to remove the copy sheet jammed somewhere in the copying machine. Unless the copy sheet is removed the warning voice "jam" is released every one minute through the steps $n_8$ and $n_6$. When the copy sheet is completely removed, no detection signal is developed from the detector js. While the detector js monitors the sheet feed state during the step $n_9$, the step $n_{10}$ is then in effect to release the sound "peep" in this case. Additional steps for processing any other types of errors may be inserted as described by the dot line in FIG. 5. The micro-instructions 7 and 8 are developed to reset the flip-flops A and $F_1$ through the steps $n_{10}$ and $n_{11}$, restoring the main routine $N_4$.

On the other hand, when it is necessary to exchange the master paper, the flip-flop C is set. Otherwise, the flip-flop C may be set when the machine demands exchange of developing agent and a serviceman. In other words, the counter which counters the total number of copies, provides the signal indicative of the need to exchange the master paper each time its count runs up to 400 and provides the signal indicative of the need to call the serviceman for periodic checkup and maintenance each time its count reaches 100,000. The signal indicating the need to exchange the toner is produced each time the copy counter counts 6,000 copies.

Figure 7:
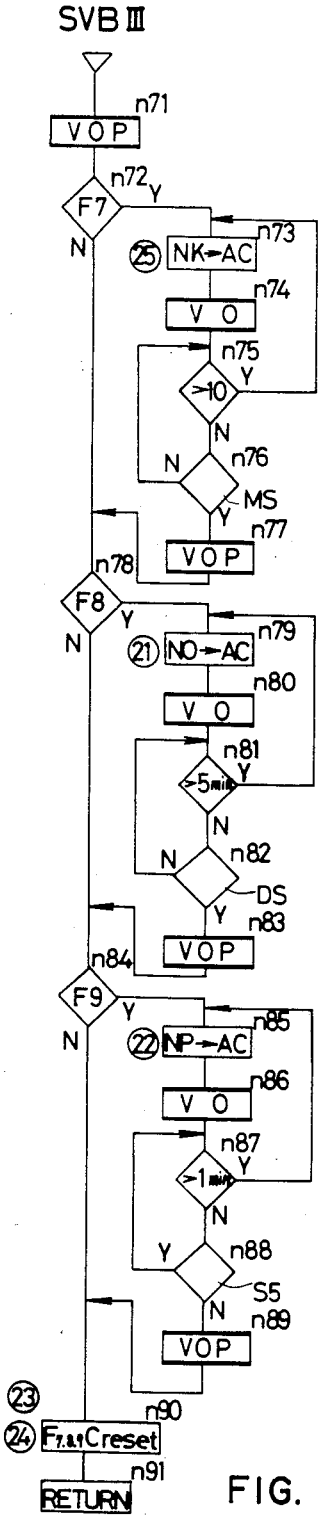
Figure 8:
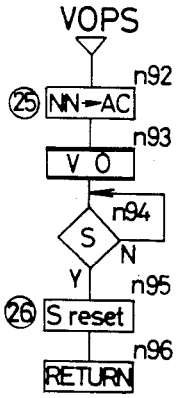

When the flip-flop C is set at the beginning of the main routine during $N_6$, the subroutine "SUB III" of FIG. 7 is selected to release the warning voice for maintenance. The confirmation sound "peep" is first delivered during the step $n_{71}$, the flip-flop $F_7$ is sensed. In the following example the photosensitive member (master sheet) is to be exchanged. Since the flip-flop $F_7$ is set by the signal from the copy counter, the word elements "master" are read out from the instruction store RM via the steps $n_{73}$ and $n_{74}$ and converted into audible frequency sound signals via the speaker 3. If the master paper is exchanged according to that voice, then the detector Ms develops the output. The step $n_{76}$ is conducted to monitor the operating condition of the detector Ms which produces the output during $n_{76}$ upon the completion of the exchange of the master member. The step $n_{77}$ follows to release the monotone sound and the next step $n_{78}$ senses the operating state of the flip-flop $F_8$. The voice "master" is released every 5 minutes unless the master paper is exchanged.

When the count of the copy counter reaches the number which requires the exchange of the developing agent, the flip-flop $F_8$ is set during the step $n_{78}$. In this case the flip-flop $F_8$ has not yet been set and the step $n_{84}$ is reached wherein the flip-flop $F_9$ is not set. The step $n_{89}$ follows where the micro-instructions 23 and 24 are developed to reset the flip-flops C and $F_7$–$F_9$. The process for maintenance is completed in this manner. As described above, the respective flip-flops $F_8$ and $F_9$ are set respectively when the count of the copy counter reaches 6,000 or 100,000. The detector $D_s$ is provided to produce a signal indicating the completion of the exchange of the developing agent, thus shifting the machine from the step $n_{82}$ of FIG. 7 to the step $n_{83}$. When the serviceman should be called, the flip-flop $F_8$ is set. Upon the completion of checkup the serviceman releases the switch Ss, etc. The steps $n_{88}$ and $n_{89}$ are performed subsequent to the completion of the serviceman's checkup.

Although the instruction store RM is designed for containing all of the word elements in the above illustrated embodiment, those word elements may be classified into sequence control, warning of error, maintenance, etc. The word elements may be stored either word by word or letter by letter.

Whereas the present invention has been described with respect to specific embodiments thereof, it will be understood that various changes and modifications will be suggested to one skilled in the art, and it is intended to encompass such changes and modifications as fall within the scope of the appended claims.

What is claimed is:

1. An audible indicator means for use in a copying machine, comprising:

a plurality of detector means for monitoring the operating condition of the copying machine;

memory means for storing therein a plurality of operational statements indicative of the operation and the operational condition of the copying machine;

control circuit means connected between the detector means and the memory means for selecting respective ones of the statements from the memory means in response to the outputs from the detector means and for developing an output signal indicative of the selected statements; and an audible sound generation means responsive to the output signal from said control circuit means for converting the selected statements into audible sounds indicative of the operation and the operational condition of the copying machine;

said control circuit means including a plurality of flip-flop means respectively connected to said plurality of detector means, said flip-flop means each developing an output signal indicative of the respective operational condition associated with its respective detector means;

a plurality of decision circuit means respectively connected to said plurality of flip-flop means for deciding whether a set output signal is being generated from its respective flip-flop means;

control circuit means connected to said decision circuit means for developing micro-instructions in response to the respective set output signals from said flip-flop means; and means responsive to the micro-instructions for selecting the respective ones of the operatinal statements from the memory means in response thereto.

2. An audible indicator means for use in a copying machine according to claim 1 wherein said operational statements are stored in said memory means in the form of sound quantizing data.

3. An audible indicator means for use in a copying machine according to claim 2 wherein said operational statements includes a verbal "cassette" statement, a verbal "check" statement, a verbal "toner" statement, and a verbal "replenish" statement.

4. An audible indicator means for use in a copying machine according to claim 1 wherein said detector means includes a copy counter for counting the number of copies which are photocopied on said copying machine.

5. An audible indicator means in accordance with claim 1 wherein said operational statements stored in said memory means comprise statements for providing audible verbal, step-by-step instructions of the copying procedure in the use of said copying machine.

6. An audible indicator means in accordance with claim 1 wherein said operational statements further comprise statements for providing an audible verbal warning indicative of an operational failure within said copying machine.

7. An audible indicator means in accordance with claim 1 wherein said operational statements further comprise statements for providing an audible verbal indication of the necessity for routine maintenance of said copying machine.

8. The audible indicator means of claim 1 wherein said audible sound generating means generates audible synthesized representations of the human voice.

* * * * *